US005205984A

United States Patent [19]

Rowe

[11] Patent Number: 5,205,984

[45] Date of Patent: Apr. 27, 1993

[54] ORTHORHOMBIC TITANIUM NIOBIUM ALUMINIDE WITH VANADIUM

[75] Inventor: Raymond G. Rowe, Niskayuna, N.Y.

[73] Assignee: General Electric Company, Schenectady, N.Y.

[21] Appl. No.: 795,576

[22] Filed: Oct. 21, 1991

[51] Int. Cl.[5] ..... C22C 14/00

[52] U.S. Cl. ..... 420/420; 148/421; 148/669; 420/418

[58] Field of Search ..... 420/418, 420; 148/421

[56] References Cited

U.S. PATENT DOCUMENTS

| | | | |
|---|---|---|---|
| 4,716,020 | 12/1987 | Blackburn et al. | 420/418 |
| 4,788,035 | 11/1988 | Gigliott, Jr. et al. | 148/421 |
| 5,032,357 | 7/1991 | Rowe | 420/418 |

OTHER PUBLICATIONS

Cho et al. Met. Trans. 21A (1990) 641.
Aswath et al. Met. Trans. 22A (1991) 817.
Ward et al. Scripta Met. 24 (1990) 617.

*Primary Examiner*—Upendra Roy
*Attorney, Agent, or Firm*—James E. McGinness; James Magee, Jr.

[57] ABSTRACT

Titanium niobium aluminide alloys having improved room temperature ductility and fracture toughness are comprised of, in atomic percent, about 18 to 30 percent aluminum, about 18 to 34 percent niobium, about 0.25 to 7 percent vanadium, and the balance substantially titanium.

9 Claims, No Drawings

ORTHORHOMBIC TITANIUM NIOBIUM ALUMINIDE WITH VANADIUM

BACKGROUND OF THE INVENTION

This invention relates to titanium based alloys, and more particularly to titanium niobium aluminide alloys containing a substantial portion of an orthorhombic crystal form comprising at least 25 percent of the volume fraction of the alloy microstructure.

New titanium aluminide alloys herein referred to as titanium niobium aluminides, and disclosed in U.S. Pat. No. 5,032,357, incorporated herein by reference, are comprised of about 18 to 32 atomic percent aluminum, 18 to 34 atomic percent niobium, and the balance essentially titanium. The titanium niobium aluminide alloys were found to have improved high temperature strength, and comparable or improved fracture toughness as compared to prior art trititanium aluminide alloys. It is believed an orthorhombic phase comprising at least 25 percent of the volume fraction of the microstructure of the titanium niobium aluminide alloys provides an important contribution to the improved properties of the alloys. Alloy compositions are sometimes hereafter shown as, for example, Ti-25A1-25Nb for an alloy comprised of 25 atomic percent aluminum, 25 atomic percent niobium, and the balance titanium.

A variety of elements have been added to the known trititanium aluminides such as molybdenum, tantalum, vanadium, hafnium, and silicon. For example, see Blackburn, M. J. and W. P. Smith, "Research to Conduct an Exploratory Experimental Investigation of Alloys" Report No. AFWAL-TR-80-4175, U.S. Air Force, WRDC, November, 1980, and U.S. Pat. Nos. 4,788,035, and 4,292,077. Some of the mechanical properties from the prior art titanium aluminides in the above references is shown in Table 1 below to compare the affect of vanadium in the alloys.

TABLE I

Mechanical Properties of Prior Art Titanium Aluminide Alloys

| Composition (Atomic Percent) | | | | 0.2% Y.S. | Ultimate Tensile Strength | Elongation |
|---|---|---|---|---|---|---|
| Al | Nb | V | Ti | (ksi) | (ksi) | (percent) |
| 25 | 14 | | Bal | 120 | 142 | 2.1 |
| 25 | 14 | | Bal | 116 | 134 | 2.6 |
| 25 | 10 | 4 | Bal | 105 | 127 | 1.7 |
| 25 | 10 | 4 | Bal | 105 | 128 | 2.0 |
| 22.5 | 10 | | Bal | 50.06 | 64.2 | 16.5 |
| 22.5 | 10 | | Bal | 70.04 | 110.2 | 20 |
| 22.5 | 5 | 5 | Bal | 108.2 | 138.4 | 6 |
| 24 | 11 | | Bal | | | 4 |
| 24 | 9 | 2 | Bal | | | 2.3 |

From the tensile testing properties shown above in Table 1, it can be seen that the addition of vanadium in such prior art trititanium aluminides has had the result of reducing the room temperature ductility of the alloys. Although it has been found useful to replace niobium with vanadium in some trititanium aluminide alloys to reduce the alloy density, ductility has been reduced.

It is an object of this invention to provide titanium niobium aluminide alloys comprised of vanadium, and having improved room temperature ductility.

It is another object of this invention to provide titanium niobium aluminide alloys comprised of vanadium, and having improved room temperature fracture toughness.

BRIEF DESCRIPTION OF THE INVENTION

These and other objects are achieved by providing a titanium based alloy comprising, in atomic percent, about 18 to 30 percent aluminum, about 18 to 34 percent niobium, about 0.25 to 7 percent vanadium, and the balance substantially titanium. The term "balance substantially titanium" means titanium is the predominate element being greater in content than any other elements present in the alloy and comprises the remaining atomic percentage. However, other elements which do not interfere with achievement of the strength, ductility and fracture toughness of the alloy may be present either as impurities or at non-interfering levels. For example, impurity amounts of oxygen, carbon, and nitrogen should be less than 0.6 atomic percent each.

DETAILED DESCRIPTION OF THE INVENTION

Alloys of this invention are improved in room temperature ductility and fracture toughness while providing good elevated temperature strength as compared to the titanium niobium aluminides. Surprisingly, I have found that titanium niobium aluminides comprised of about 0.25 to 7 atomic percent vanadium are substantially improved in room temperature ductility and toughness. Although strength can be decreased by the addition of vanadium in the alloy, high temperature strength is still acceptable for a variety of applications, such as casings, rings, afterburner nozzles or flaps, and compressor components in gas turbines.

The alloys of this invention can be formed by conventional methods used for melting and casting titanium aluminides. For example, alloys can be formed by plasma arc skull melting and drop casting in chilled copper molds. The alloys can also be formed by rapid solidification methods such as melt spun ribbons and hot isostatic pressing to consolidate the ribbons.

Above about 30 atomic percent aluminum, undesirable embrittling phases are formed in increasing amounts reducing the microstructural stability and ductility of the alloys of this invention. Preferably, aluminum is less than about 26 atomic percent. Above about 34 atomic percent niobium, an undesirable sigma phase is formed in increasing amounts and microstructural stability and ductility are decreased. Preferably, niobium is less than about 30 atomic percent. Preferably vanadium is about 0.5 to 7 atomic percent, and most preferably about 1 to 5 atomic percent.

EXAMPLES

A number of titanium niobium aluminide alloys and titanium niobium aluminide alloys comprised of vanadium were formed by conventional inert gas plasma melting in a copper chilled crucible, and drop cast in copper chilled molds to form ingots about 1.2 inches in diameter. Another alloy was formed by conventional melt spinning to form ribbons that were consolidated by hot isostatic pressing at 1,000° C., 30 ksi pressure, for 3 hours into ingots about 1 inch in diameter. Some of the ingots were homogenized by heating to about 1,250° C. for 24 hours in an inert atmosphere. The ingots were placed in 2 inch diameter stainless steel extrusion cans, and extruded at 1,000° C. through a die having an inside diameter of about 9/16 of an inch to form rods.

The extruded rods were machined to form blanks for tensile testing. The blanks were heat treated by either heating above the beta transformation temperature, or performing an aging heat treatment, or a combination of both. The beta transformation temperature is the temperature at which the microstructure of titanium or titanium alloys transforms from the low temperature alpha or alpha-2 phase to the high temperature beta phase. Beta transformation temperatures vary depending upon the composition of the titanium alloy, and beta heat treatments were performed at 1,075° to 1,125° C. for about 1 hour in an argon atmosphere.

In the alloys of this invention the aging heat treatment forms the orthorhombic phase and stabilizes the microstructure. Aging heat treatments were performed at 815° C. for 2, 4, or 24 hours in an argon atmosphere. Some blanks were given an additional long term aging heat treatment at 760° C. for 100 hours. Controlled cooling rates after the beta and aging heat treatments were achieved by cooling the blanks in the furnace cooling chamber (cc) to produce an approximate 5° C. per second cooling rate, or in a refractory brick (bc) thermal mass to produce an approximate 2° C. per second cooling rate. The alloy composition and thermomechanical processing for the blanks from each extruded rod is shown below in Table II. In Table II, rod 2 was formed from the melt spun ribbons consolidated into ingots, and rods 1, and 3–6 were formed from the drop cast ingots.

TABLE II

| Rod No. | Composition (atomic percent) Al | Nb | V | Ti | Homogeniza-tion (°C.) | Beta Heat Treat-ment (°C.) | Aging Heat Treatment (°C.) |
|---|---|---|---|---|---|---|---|
| 1 | 21.9 | 24.1 | | Bal | 1250/ 24 hr | — | 815/4 hr/cc |
| 2 | 21.7 | 25.3 | | Bal | — | 1125/ 1 hr/ bc. | 815/2 hr/cc |
| 3 | 21.5 | 20 | 5 | Bal | — | — | 815/24 hr/cc+ 760/100 hr/cc. |
| 4 | 21.5 | 20 | 5 | Bal | — | 1075/ 1 hr/cc | 815/24 hr/cc+ 760/100 hr/cc. |
| 5 | 22 | 19 | 5 | Bal | 1250/ 24 hr | 1075/ 1 hr/cc | 815/24 hr/cc+ 760/100 hr/cc. |
| 6 | 22 | 23 | 1 | Bal | 1250/ 24 hr | — | 815/24 hr/cc+ 760/100 hr/cc. |

cc chamber cooling 5° C. per second
bc brick cooling 2° C. per second

Tensile test samples were electric discharge machined from the blanks, and ground to form tensile specimens having a 0.4 inch gauge length and a 0.08 inch diameter gauge section. The tensile tests were performed at room temperature in air and at a 650° C. in vacuum on an INSTRON tensile machine in compliance with ASTM E8, 1990 *Annual Book of ASTM Standards Vol.* 03.01. The tension testing results are shown below in Table III.

TABLE III

Tensile Properties of Titanium Niobium Aluminide Alloys Compared to Alloys of This Invention with Vanadium Addition

| Rod No. | Composition (Atomic Percent) Al | Nb | V | Ti | Test Temp. (°C.) | 0.2% Y.S. (ksi) | U.T.S. (ksi.) | E-longa-tion (%) |
|---|---|---|---|---|---|---|---|---|
| 1 | 21.9 | 24.1 | | Bal | R.T. | 182.2 | 195.6 | 3.57 |
| | | | | | 650° | 152 | 170.5 | 13.48 |

TABLE III-continued

Tensile Properties of Titanium Niobium Aluminide Alloys Compared to Alloys of This Invention with Vanadium Addition

| Rod No. | Composition (Atomic Percent) Al | Nb | V | Ti | Test Temp. (°C.) | 0.2% Y.S. (ksi) | U.T.S. (ksi.) | E-longa-tion (%) |
|---|---|---|---|---|---|---|---|---|
| 2 | 21.7 | 25.3 | | Bal | R.T. | 164.3 | 170.3 | 0.9 |
| | | | | | 650° | 127.2 | 146.9 | 0.4 |
| 3 | 21.5 | 20 | 5 | Bal | R.T. | 130.4 | 168.2 | 18.8 |
| | | | | | 650° | 99.2 | 111.9 | 16.5 |
| 4 | 21.5 | 20 | 5 | Bal | R.T. | 108.7 | 136.6 | 12.5 |
| | | | | | 650° | 94.5 | 110.6 | 14.9 |
| 5 | 22 | 19 | 5 | Bal | R.T. | 105.1 | 131.6 | 5.2 |
| | | | | | 650° | 95.8 | 122.3 | 13 |
| 6 | 22 | 23 | 1 | Bal | R.T. | 158.02 | 189.4 | 8.8 |
| | | | | | 650° | *110.1 | *110.1 | *0.29 |

*Prematurely failed at grinding crack in tensile test sample.

Several alloys were formed into rods by the methods described above. No homogenization heat treatment was performed prior to extruding the rods. The rods were cut into blanks for fracture toughness testing, and the blanks were heat treated by the methods described above for the tensile testing. The alloy composition and heat treatments for the blanks from each extruded rod is shown below in Table IV.

TABLE IV

Treatment of Blanks for Fracture Toughness Testing

| Rod No. | Blanks | Composition (atomic percent) Al | Nb | V | Ti | Beta Heat Treatment (°C.) | Aging Heat Treatment (°C.) |
|---|---|---|---|---|---|---|---|
| 1 | A | 21.3 | 25.3 | — | Bal | 1125/1 hr/ BC | 815/2 hr/CC |
| 1 | B | 21.3 | 25.3 | — | Bal | 1125/1 hr/ BC | 815/2 hr/ CC+ 760/100 hr/ CC |
| 2 | C | 22.2 | 19.3 | 5.3 | Bal | — | 870/1 hr/CC |
| 3 | D | 21.5 | 20 | 5 | Bal | — | 815/24 hr/ CC+ 760/100 hr/ CC |
| 3 | E | 21.5 | 20 | 5 | Bal | 1075/1 hr/ CC | 815/24 hr/ CC+ 760/100 hr/ CC |

cc chamber cooling 5° C. per second
bc brick cooling 2° C. per second

Small bars about 1 by 0.1 by 0.1 inch were cut from the blanks by electric discharge machining. A notch about 0.05 inch deep was formed about midlength of the bar by electric discharge machining. Some of the notched bars were cyclic compression precracked according to the method disclosed in "The Mechanical Properties of Titanium Aluminides Near Ti-25Al-25Nb," R. G. Rowe, The Minerals, Metals & Materials Society, No. 30, 1991, pp. 387–398, incorporated herein by reference. In this disclosure, a correlation between the fracture toughness of bars having an electric discharge machined notch, and bars having fatigue precracked notches was found for Ti-24Al-11Nb. The fracture toughness of a bar having a fatigue precracked notch could be estimated from the fracture toughness of a bar having an electric discharge machined notch using a multiplying factor of 0.73.

Three point bending fracture toughness tests were performed in conformance with Department of the Army standard MIL-STD-1942A (Proposed): "Flexural Strength of High Performance Ceramics at Ambient Temperatures". The results of the feracture toughness testing are shown below in Table V. The estimated fracture toughness for a notched bar having a fatigue precrack is shown in Table V for some of the tests. The estimated fracture toughness was obtained by multiplying the fracture toughness of the electric discharge machined notched bar by the 0.73 factor discussed above.

TABLE V

| | | | | | Room Temperature Fracture Toughness | | |
|---|---|---|---|---|---|---|---|
| | | | | | Bar EDM notched Fracture Toughness | Estimated Pre-Cracked Fracture Toughness | Pre-Cracked Bar Fracture Toughness |
| Blanks | Al | Nb | V | Ti | (ksi · $\sqrt{in}$) | (ksi · $\sqrt{in}$) | (ksi · $\sqrt{in}$) |
| A | 21.3 | 25.3 | | Bal. | 24.5 | 17.9 | |
| B | | | | | 34.2 | 25 | |
| B | | | | | 26.9 | 19.7 | |
| C | 22.2 | 19.3 | 5.3 | Bal. | Plastic* | | |
| C | | | | | Plastic* | | |
| C | | | | | Plastic* | | |
| D | 21.5 | 20 | 5 | Bal. | | | 26.7 |
| D | | | | | | | 25.9 |
| E | | | | | | | 26.4 |
| E | | | | | | | 27.7 |

*Plastic bending before fracture.

The oxidation resistance of an alloy of this invention was compared to a titanium niobium aluminide, and conventional titanium alloys. A first alloy, herein referred to as Ti-6242, was comprised of 6 weight percent aluminum, 2 weight percent tin, 4 weight percent zirconium, 2 weight percent molybdenum, and the balance titanium. A second alloy, herein referred to as Beta-21S, was comprised of 15 weight percent molybdenum, 2.7 weight percent niobium, 3 weight percent aluminum, 0.2 weight percent silicon, and the balance titanium. A third alloy, herein referred to a AF2, was comprised of 6.4 weight percent aluminum, 1 weight percent niobium, 3.2 weight percent tin, 3 weight percent zirconium, 2.5 weight percent hafnium, 0.3 weight percent ruthenium, 0.14 weight percent silicon, 0.33 weight percent germanium, and the balance titanium. The composition of the titanium niobium aluminide, and the titanium niobium aluminide comprised of vanadium of this invention are shown below in Table VI.

A sample of each alloy was exposed to a combustion flame at 1,300° F. for 550 hours in a thermally cycled test. The samples were cycled three times per hour by heating in the flame for 19 minutes followed by forced air cooling for 1 minute, and repeating the heating and cooling. The weight gain of each sample was measured to determine the total weight gain associated with oxidation and oxygen absorption, and is shown below in Table VI.

TABLE VI

| | Oxidation in Combustion Flame | |
|---|---|---|
| Alloy | Weight Gain ($mg/cm^2$) | Comments |
| Ti-6242 | 0.878 | Spalling oxide |
| Beta-21S | 0.825 | |
| AF2 | 0.623 | |
| Ti-22Al-27Nb | 0.565 | |
| Ti-22Al-26Nb-1V | 0.639 | |

Referring to Table III, alloys of this invention, rod numbers 3–6, can be compared to the titanium niobium aluminide alloys, rod numbers 1–2. It can be seen that the room temperature ductility of the alloys of this invention is greatly improved over the titanium niobium aluminides. For example, compare the tensile properties of rod number 1 to the tensile properties of rod number 6, both were similarly heat treated by homogenizing prior to extrusion and no beta heat treatment was performed. The room temperature elongation of rod number 6 is more than double the elongation of rod number 1, and the yield strength of rod number 6 is comparable to the yield strength of rod number 1.

Next compare the tensile properties of rod number 2 with rod number 4. The homogenization heat treatment was not performed on rods 2 and 4, and both rods were given the beta heat treatment after extrusion. Although the yield strength of rod number 4 is reduced as compared to rod number 2, the room temperature ductility is improved by a factor of 12.

Rod number 3 is a vanadium bearing alloy of this invention that was given a direct aging heat treatment, i.e. no homogenization or beta heat treatment. The room temperature elongation of the tensile sample from rod 3 is about 19 percent, far higher than the ductility of the titanium niobium aluminide samples.

By referring to Table V, it can be seen that the fracture toughness of alloys of this invention is significantly improved over the room temperature fracture toughness of the prior art titanium niobium aluminide. Note that the Ti-22.2Nb-19.3A1-5.3V alloy of this invention experienced plastic bending before fracture of the notched bar. Plastic bending before fracture is an indication that the fracture toughness is substantially higher than the fracture toughness of the titanium niobium aluminide bars.

Referring to Table VI, the sample of alloy Ti-6242 experienced the largest weight gain in the cyclic oxidation test. Spalling of the oxide was observed on the sample of alloy Ti-6242 so that its actual weight gain was greater than the 0.878 milligrams per square centimeter. The sample of oxidation-resistant alloy AF2 had the lowest weight gain of the conventional titanium alloys. The titanium niobium aluminide sample, alloy Ti-22A1-27Nb, had the lowest weight gain of 0.565 milligrams per square centimeter. The sample of alloy Ti-22A1-26Nb-1V, an alloy of this invention, had oxidation resistance comparable to the conventional AF2 alloy. Although it is known the oxidation resistance of titanium alloys or titanium aluminide alloys is reduced by vanadium, the oxidation resistance of the vanadium bearing alloys of this invention is comparable to or improved over known beta or alpha plus beta titanium alloys that are vanadium free.

What is claimed is:

1. A titanium aluminum alloy, comprising in atomic percent:

about 18 to 30 percent aluminum, about 18 to 34 percent niobium, about 0.25 to 7 percent vanadium, and the balance substantially titanium.

2. A titanium alloy according to claim 1 comprising, about 18 to 26 percent aluminum.

3. A titanium alloy according to claim 1 comprising, about 18 to 30 percent niobium.

4. A titanium alloy according to claim 1 comprising, about 0.5 to 7 percent vanadium.

5. A titanium alloy according to claim 2 comprising, about 18 to 30 percent niobium.

6. A titanium alloy according to claim 3 comprising, about 0.5 to 7 percent vanadium.

7. A titanium alloy according to claim 3 comprising, about 1 to 5 percent vanadium.

8. A gas turbine component, comprising in atomic percent:

about 18 to 30 percent aluminum, about 18 to 34 percent niobium, about 0.25 to 7 percent vanadium, and the balance substantially titanium.

9. A gas turbine component according to claim 8 comprising, about 18 to 26 percent aluminum, about 18 to 30 percent niobium, and about 1 to 5 percent vanadium.

* * * * *